US008783309B2

(12) United States Patent
Betlem

(10) Patent No.: US 8,783,309 B2
(45) Date of Patent: Jul. 22, 2014

(54) OUTDOORS AIR CONDITIONER COVER

(76) Inventor: James R. Betlem, Fairport, NY (US)

( * ) Notice: Subject to any disclaimer, the term of this patent is extended or adjusted under 35 U.S.C. 154(b) by 521 days.

(21) Appl. No.: 12/931,531

(22) Filed: Feb. 3, 2011

(65) Prior Publication Data

US 2011/0186196 A1 Aug. 4, 2011

Related U.S. Application Data

(60) Provisional application No. 61/337,354, filed on Feb. 3, 2010.

(51) Int. Cl.
*B65D 65/02* (2006.01)
*F25B 39/04* (2006.01)

(52) U.S. Cl.
USPC ..... 150/165; 150/154; 62/259.1

(58) Field of Classification Search
USPC ..... 150/154, 165; 62/259.1; 206/320.321
See application file for complete search history.

(56) References Cited

U.S. PATENT DOCUMENTS

| | | | | | |
|---|---|---|---|---|---|
| 3,831,321 | A * | 8/1974 | Johnson | 49/465 |
| 4,308,905 | A * | 1/1982 | Gallagher | 150/165 |
| 4,376,082 | A * | 3/1983 | Heck | 261/127 |
| 4,625,784 | A * | 12/1986 | Boroson | 150/165 |
| 4,815,530 | A * | 3/1989 | Scott | 165/134.1 |
| 5,097,678 | A * | 3/1992 | Aubuchon | 62/506 |
| 5,158,486 | A * | 10/1992 | Tamame | 62/506 |
| 5,307,849 | A * | 5/1994 | Nelson | 150/165 |
| 5,809,800 | A * | 9/1998 | Deal | 62/507 |
| 6,397,617 | B1 * | 6/2002 | Johnson | 62/259.1 |
| 7,140,194 | B1 * | 11/2006 | Miller | 62/259.1 |
| 7,332,011 | B1 * | 2/2008 | Sandberg | 55/491 |
| 7,373,962 | B2 * | 5/2008 | Oubichon | 150/154 |
| 7,591,870 | B2 * | 9/2009 | Simmons et al. | 55/511 |
| 2007/0204945 | A1 * | 9/2007 | Ross | 150/165 |

* cited by examiner

*Primary Examiner* — Sue A Weaver
(74) *Attorney, Agent, or Firm* — Bassett IP Strategies; David F. Bassett

(57) ABSTRACT

The present invention comprises a cover for wintertime protection of an outdoor air conditioning unit (OACU). The cover provides a rigid top piece to provide protection from falling objects and a semi-permeable side skirt to reduce dirt and debris entering the unit while still allowing moisture to evaporate from the unit and means to attach the cover to the unit. The cover may also be equipped with foam padding for the underside of the rigid top piece which provides for abrasion resistance for the OACU and will also provide for tilting of the cover when an unevenly distributed weight load is applied to the upper surface of the cover; the tilting facilitates runoff of ice and snow from the unit reducing the weight load bearing on the OACU.

14 Claims, 5 Drawing Sheets

OUTDOORS AIR CONDITIONER COVER

CROSS-REFERENCE TO RELATED PATENT APPLICATIONS

Priority for this patent application with the exception of claim 11 is based upon provisional patent application 61/337,354 (filed on Feb. 3, 2010). The disclosure of this U.S. patent application is hereby incorporated by reference into this specification.

BACKGROUND OF THE INVENTION

Central air conditioners are used to maintain indoor ambient air temperatures at comfortable ranges during hot weather. In the northern United States, the air conditioning season will typically run through the summer months; in the southern United States, the air conditioning season will typically run from mid-spring through mid-autumn. Central air conditioners typically consist of an indoor air conditioning unit, an outdoor air conditioning unit, and plumbing, electrical, and ductwork between the units and throughout the building to be cooled.

Outdoor air-conditioning units (OACU's) typically include a compressor, a condenser, a grill, various piping and valves, and a fan all contained within a metal housing and are powered by electrical wiring routed from the building they serve. The purpose of an indoor air-conditioning unit is to transfer the heat from a building or structure to refrigerant in the air-conditioning system piping which vaporizes to a gaseous state thereby lowering the temperature within the building, and then transmits this refrigerant gas via piping to the outdoor air-conditioning unit where the compressor converts the gas back to a liquid in the condenser, thereby generating heat that is transferred to ambient environment outside of the building or structure with the fan. The outdoor air-conditioning units are frequently located close to the building they serve so that the distance that the transfer piping requiring thermal insulation must traverse is minimized. They are often located in a position where the eaves of the building and trees or shrubbery will shade the unit from direct solar radiation.

During the winter months when air conditioning is not utilized, the outdoor air-conditioning unit is susceptible to damage from snow, ice, and other hard objects falling from the eaves and trees. Since the fan motor of an outdoor unit is frequently mounted to the underside of the top panel of the unit, the fan motor is particularly susceptible to damage. Furthermore, the top panel is usually formed with fins or a grille which are also easily damaged by falling objects. Therefore, it is desirable for an air conditioner cover to be capable of protecting against such damage from wind-driven precipitation and hard, falling objects, yet be easily installed or removed and stowable during the warm seasons. It is important that through ventilation can enter the sides of the unit to dry out moisture inside the unit which may lead to condensation and ultimately to corrosion. If the cover is supplied as an accessory by the air conditioning manufacturer, a displayed trademark or name may be of value.

People oftentimes use a simple piece of plywood with a cinderblock placed on top of it to protect the OACU during the off-season. There are several limitations associated with this including the potential to scratch and dent the upper surface of the OACU and the fan grille and the aesthetics of the plywood and cinderblock.

Covers to protect the OACU have been available since the 1960's, but those have primarily been simple canvas covers designed to totally or nearly totally enclose the OACU. However, these devices do not address the perils discussed earlier, that of falling objects such as ice and tree limbs, or rain and moisture trapped inside the covered OACU. Aubuchon provided a ventilating protective cover for top-discharge air conditioners (U.S. Pat. No. 5,097,678) designed to provide corrosion protection to the upper portion of the OACU. Aubuchon's cover used an impervious skirt that covered only the upper portion of the OACU and only provided protection to that portion of the OACU. Because the skirt used by Aubuchon was impervious to moisture, use of the skirt to cover more than 50 percent of the OACU would result in corrosion of the underlying OACU as trapped moisture would be unable to escape the unit. Nelson provided an air conditioner cover (U.S. Pat. No. 5,307,849) with a panel and a flexible shroud to protect the air conditioner cover. This cover provided protection against falling objects but provided no protection from moisture to be trapped inside the covered OACU which could lead to corrosion of the OACU. The present invention addresses all these limitations and is described herewith.

Additionally, a fully enclosed OACU is an inviting home for rodents, which may lead to additional damage to the unit. The present invention does not fully enclose the OACU and does not present an attractive home for rodents.

BRIEF SUMMARY OF THE INVENTION

The present invention comprises a cover for wintertime protection of an outdoor air conditioning unit (OACU). The cover provides a rigid top piece to provide protection from falling objects and a semi-permeable side skirt to reduce dirt and debris entering the unit while still allowing moisture to evaporate from the unit and means to attach the cover to the unit. The cover may also be equipped with foam padding for the underside of the rigid top piece which provides for abrasion resistance for the OACU and will also provide for tilting of the cover when an unevenly distributed weight load is applied to the upper surface of the cover; the tilting facilitates runoff of ice and snow from the unit reducing the weight load bearing on the OACU.

DETAILED DESCRIPTION OF THE INVENTION

Various embodiments of the present invention provide a protective cover for an outdoor air-conditioning unit (OACU) of a split system air conditioning system.

Figure 1:
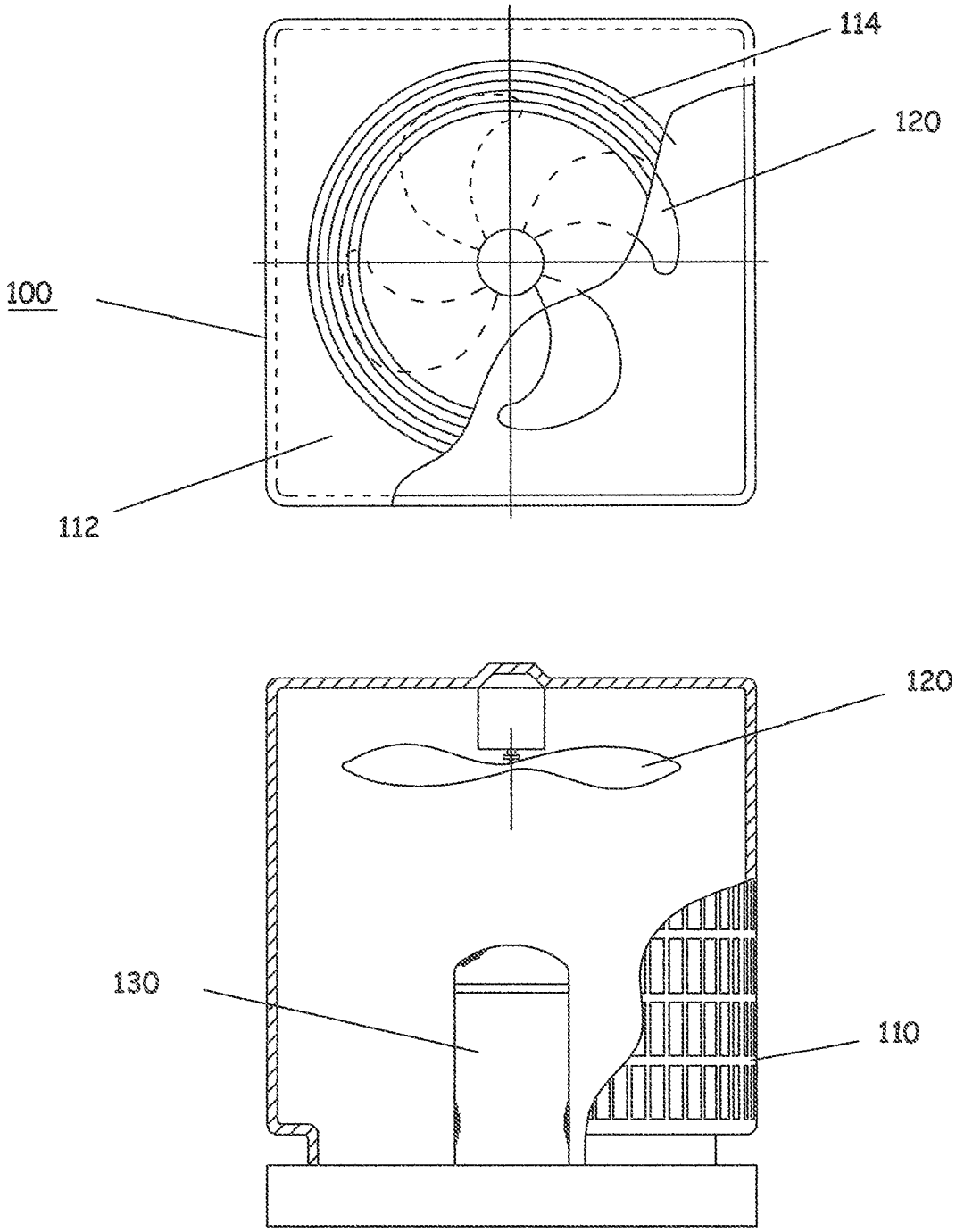
FIG. 1 is an illustration of a conventional outdoor air conditioning unit.

In FIG. 1, a conventional OACU 100 is illustrated. The OACU 100 comprises several mechanical and control elements housed inside a protective vented metal guard sheathing 110. The protective vented metal guard sheathing has a solid flat lid 112 with a centralized nearly circumferential outlet grill 114. The outlet grill 114 allows during unit operation for a fan 120 to discharge heat from a condenser unit 130. The sides of the guard sheathing 110 are vented to allow cooling air to enter the OACU 100. Due to the requirements to allow hot air to blow from the unit, the outlet grill 114 does not offer the underlying elements physical protection from falling debris nor does it offer protection from weather such as snow, hail, rain, and ultraviolet light (UV).

Figure 2:
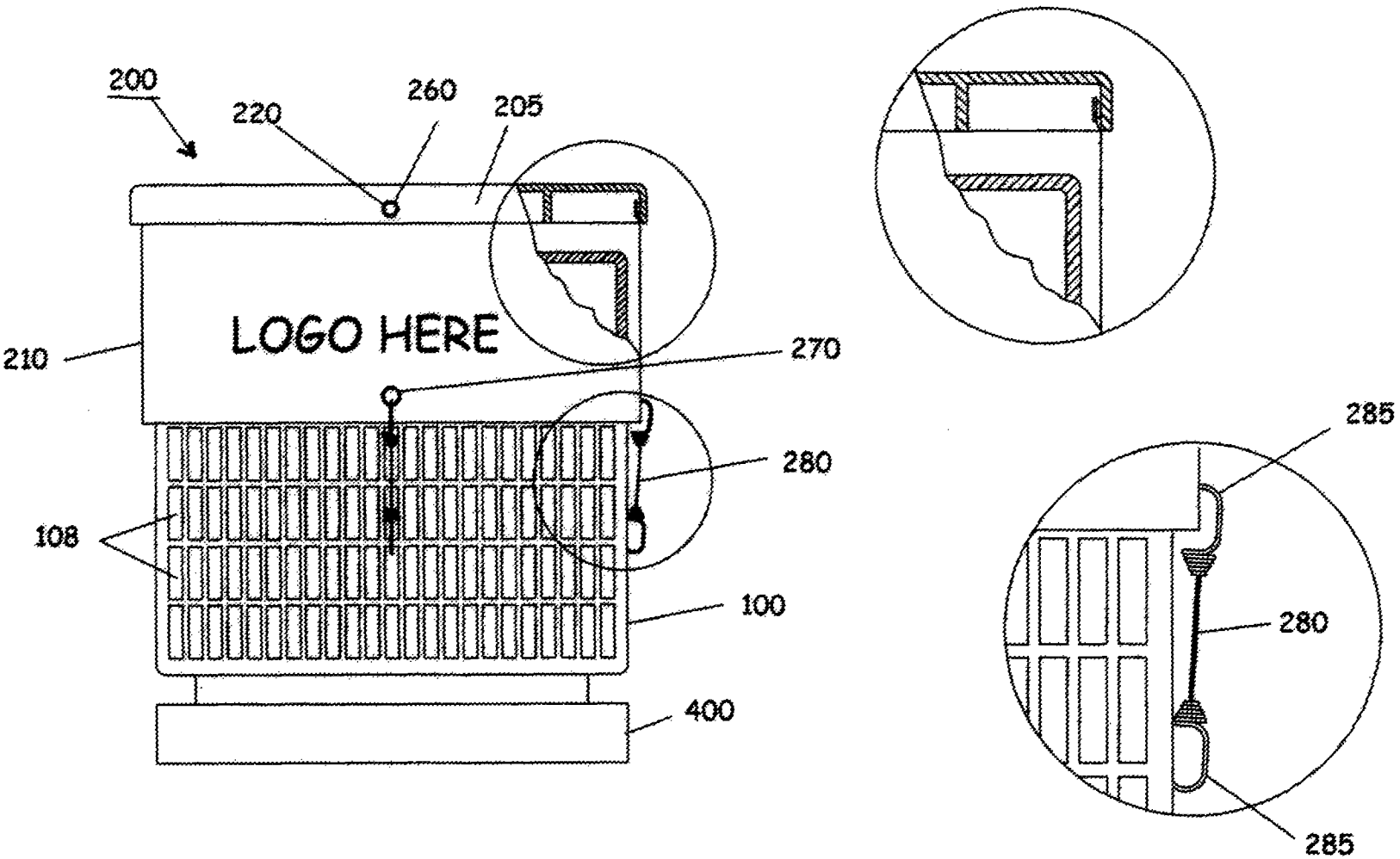
FIG. 2 is an illustration of one preferred embodiment of a protective cover for a conventional outdoor air conditioning unit.

In FIG. 2, one preferred embodiment of a protective cover for an OACU is presented. A protective cover 200 for an OACU 100 is placed directly on top of the OACU 100. The protective cover 200 is comprised of a panel 205 which rests on the OACU 100 and a skirt 210 which covers the sides of the OACU 100. In one preferred embodiment, the thickness of the panel 205 is between about 2 inches and 2½ inches. In order to facilitate easy handling and carrying of the cover 200 it is desirable for the skirt 210 and the panel 205 to be comprised of a lightweight material such as plastic or the like.

The panel 205 is comprised of a rigid or semi-rigid material to offer protection from impact by falling objects to the OACU 100. The panel is sized such that the entire upper surface of the OACU 100 is covered when the panel 205 is placed on the top surface of the OACU 100. The panel 205 may be nominally larger than both the OACU 100 upper surface length and width. In one preferred embodiment of the invention, the panel 205 is sized such that it has essentially the same length and width of the stabilization pad 400 upon which the OACU 100 rests.

Figure 3:
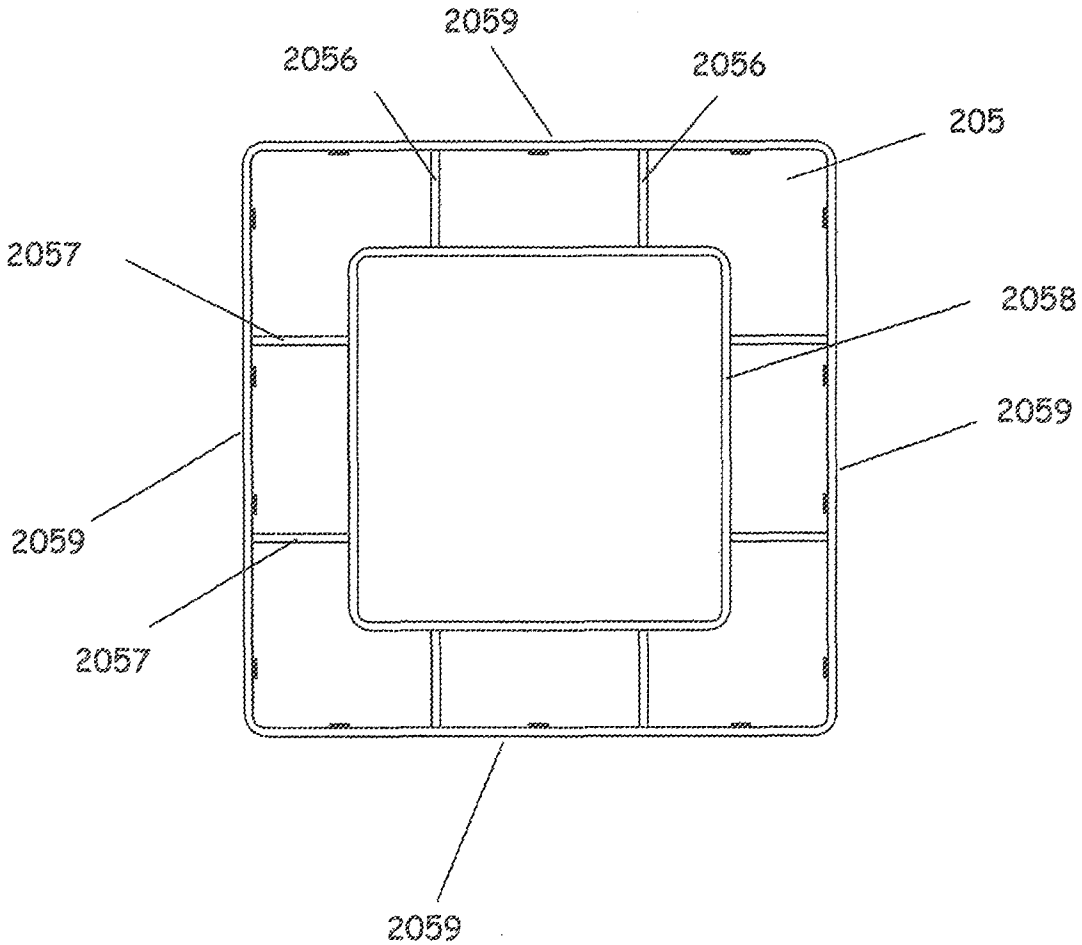
FIG. 3 is an underfoot view of a preferred embodiment of a protective cover for a conventional outdoor air conditioning unit.

FIG. 3 depicts an underfoot view of the panel 205. In the preferred embodiment depicted in FIG. 3, the underside of the panel 205 comprises a network of ridges 2056, 2057, 2058 which provide both strength to the panel and also reduce the panel weight. In the embodiment depicted, ridges are positioned in a rectilinear grid 2056, 2057 around a rectangular ridge 2058. In the preferred embodiment depicted in FIG. 3, the height of the ridges is equivalent to the thickness of the panel edges 2059; so, if the panel 205 were placed on a flat surface larger than the panel 205 itself, the panel 205 would sit flat on the flat surface and essentially the entire bottom surface of the panel 205 would make contact with the flat surface. In another preferred embodiment, the vertical thickness of the panel edges is greater than the height of the ridges. This allows for the bottom of the panel 205 to have a lower elevation than the top of the OACU when the panel is placed on top of the OACU, which will help to keep the panel 205 in place when resting on the OACU. It should be readily apparent to those skilled in the art that the grid pattern may be modified without deviating from the principal of the invention.

Referring again to FIG. 3, the panel 205 is preferably constructed of an UV resistant material. Representative examples of such materials include, but are not limited to chloropolyvinylcopolymer (CPVC), a polyethylene copolymer rubber blend (such as the Black Pad manufactured by Diversitech of Pennington, N.J.), and the like. The panel 205 may also be coated with an UV resistant coating. One may use any one or more of the UV resistant coatings disclosed in U.S. Pat. Nos. 5,199,979 (UV resistant, abrasion resistant coatings), 4,680,232 (abrasion and UV resistant coating compositions), 5,938,831 (water and UV resistant clear coat sealant and finish for wood signs and other surfaces), and the like. The entire disclosure of each of these United States patents is hereby incorporated by reference into this specification. The UV resistance increases the life expectancy of the protective cover 200 as the cover 200 will be exposed to the outdoor elements for several months each year.

Referring again to FIG. 2 and the preferred embodiment depicted therein, the skirt 210 may be attached to the panel 205 via readily available means. These means may include items such as staples. It may be desirable for the skirt 210 to be detachable from the panel 205 for several reasons. These include allowing the skirt 210 to be aired out and dried prior to being stored during the cooling season that the OACU 100 is in service, ease of storage, and ability to replace the skirt 210 if it is damaged. The skirt 210 is connected to the panel 205 through any of several readily available, means for attachment 220. As depicted in FIG. 2, the means for attachment 220 may include items such as 2 part eyelet snaps 260. In the depicted preferred embodiment, one part of the 2 part eyelet snap 260 is attached to the panel 205 via a screw or rivet and the other part of the 2 part eyelet snap 260 is attached to the skirt 210 via a rivet. The skirt 210 is preferably constructed of a flexible semi-permeable material which will allow gases such as air and water vapor to pass through, but do not allow solid objects to pass. A representative example of such a material is a polypropylene mesh manufactured by Meyco Products of Melville, N.Y. Other representative examples would be a semi-permeable fabric as that disclosed in U.S. Pat. Nos. 7,468,117 (method of transferring a wet tissue web to a three-dimensional fabric), 5,924,134 (protective garment with apertured closed-cell foam liner), 5,640,718 (Firefighter garment with combination facecloth and moisture barrier), and the like. The entire disclosure of each of these U.S. patents is hereby incorporated by reference into this specification.

In another preferred embodiment, not depicted, the skirt 210 is connected to the panel 205 using Velcro strips.

The protective cover 200 is designed to allow moisture that gets into the OACU 100 to escape which minimizes corrosion of the OACU 100 while it is not in operation. To facilitate this, the skirt 210 is sized such that the length of the skirt 210 is no more than about 75 percent of the height of the OACU 100. It is preferred that the length of the skirt 210 is sized such that the skirt 210 is at least about 50 percent of the height of the OACU 100. Due to the semi-permeable nature of the skirt 210, trace amounts of moisture can enter the protective cover; but the semi-permeable nature of the skirt 210 also allows for this moisture to be removed from the OACU 100 when wind blows across the unit, when sunlight warms the unit, and through other natural drying processes. The choice of a semi-permeable skirt allows for the protective cover 200 to provide improved corrosion protection relative to existing OACU covers.

The skirt 210 is preferably secured to the sides of the OACU 100 via any of several readily available means. One such means is via a series of eyelets 270 placed in the lower portion of the skirt 210. These eyelets 270 provide for connecting the skirt 210 to the OACU 100 via stretch cords 280. At least one eyelet 270 will be attached on each side of the skirt 210. OACUs from various manufacturers have louvers 108 in their sides that may be aligned vertically as shown in FIG. 1, or horizontally, or as rectangular openings. One end of each stretch cord 280 is placed in the eyelet 270 and the other end is placed in a louver. Prior to placing the other end in the louver, the stretch cord 280 is stretched to apply a downward force on the skirt 210 and keep it tight against the OACU 100. It is preferable for each of the stretch cords 280 to have a length of at least about 4 inches and at most about 8 inches. It is more preferable for the stretch cords 280 to each have a length of about 6 inches.

To minimize the possibility of scratching the OACU 100 when the stretch cords 280 are attached to the OACU 100, the stretch cord clips 285 may have a plastic coating applied by any readily available means. An example of such a stretch cord is the StarBrite Universal Bungee manufactured by Star brite Corp. of Fort Lauderdale, Fla. By not scratching the OACU 100, the aesthetics of the OACU 100 are not compromised, nor are corrosion nucleation sites created.

For advertising purposes it may be desirable to show graphics on the skirt 210. For example the distributor's name and logo may be so displayed. The advertising may be placed on the skirt 210 via screen printing.

As an alternative means of providing iconic artwork such as a logo for advertising, artwork could be printed on a plastic or metal plate and attached to the skirt 210 with pop rivets applied through holes in the plate and backed on the inside of the skirt with flat washers that engage an extended surface area of the skirt 210, preventing the unintentional retraction of the pop rivet back through the skirt 210. This method may be of particular value when the information to be applied is customized to the identification of the OACU 100 belonging to a particular building or address.

Figure 4:
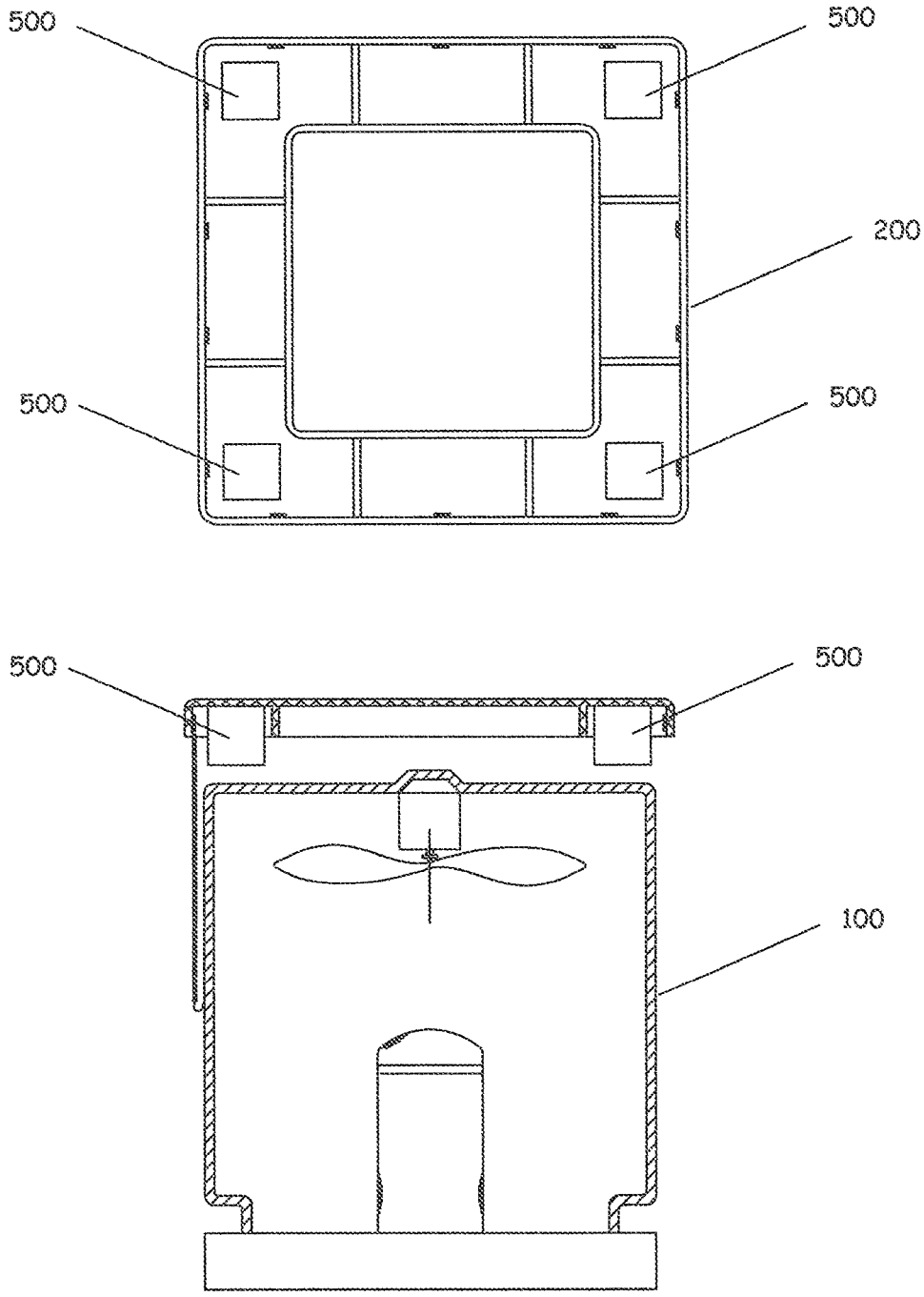
FIG. 4 is an illustration of another preferred embodiment of a protective cover for a conventional outdoor air conditioning unit.

FIG. 4 depicts another preferred embodiment of the protective cover 200. In the preferred embodiment, depicted in FIG. 4, at least one compressible cushion is placed on top of the OACU 100. Representative cushions could include foam blocks, foam balls, synthetic sponges, and the like covered with an impermeable surface. As a representative example, a multiplicity of blocks may be used as the cushion. In the preferred embodiment depicted in FIG. 4, four blocks 500 are placed on the top of the OACU 100 and the protective cover 200 is set upon the multiplicity of blocks 500. Each block 500 preferably compressible and has an impervious surface which will not absorb nor retain moisture. The impervious surface may consist of an elastic paint coating such as Duration Lifetime Coating manufactured by Sherwin-Williams of Cleveland, Ohio, a synthetic rubber coating such as Plasti Dip manufactured by Plasti Dip International of Blaine, Minn., and the like. Each block is preferably sized to a square with a length of approximately 4 inches. Each block 500 may be attached to the OACU 100 by readily available means which allow for temporary attachment such as Velcro or low adhesive glue (e.g. Removable Glue Stic glue manufactured by Avery Dennison of Brea, Calif.). It is preferred to use at least 3 blocks to support the protective cover 200. The blocks 500 provide several benefits when installing the protective cover 200. These benefits include ease of installation and removability. The compressibility of the blocks 500 also allow for a slight tilting of the protective cover 200 when a load is applied unevenly to the upper surface of the protective cover 200 (such an uneven load may be caused by snow drifting unevenly or from a branch falling onto a corner of the protective cover 200) which allows for snow and other objects to run or slide off the top of the protective cover 200. The stretch cords 280 provide an additional benefit, when a non-evenly distributed load upon the protective cover 200 has been displaced due to a tilting of the protective cover 200, the stretch cords 280 provide a force to relevel the protective cover 200.

The cushion also reduces the potential for the protective cover 200 to scratch the upper surface of the OACU 100. The cushion also provides cushioning to the OACU 100 in such an event as when an object strikes the protective cover 100.

A soft foam with essentially no impermeable surface is not as desirable due to the potential for the soft foam to attract and retain moisture creating an environment suited for mold and fungus growth.

In another preferred embodiment, not depicted, a spray on foam material may be attached to the bottom of the protective cover. This spray on foam may then be coated with a thin sheet of plastic material or the like to prevent the spray on foam from sticking to the OACU 100 and to limit mold and fungus growth.

Figure 5:
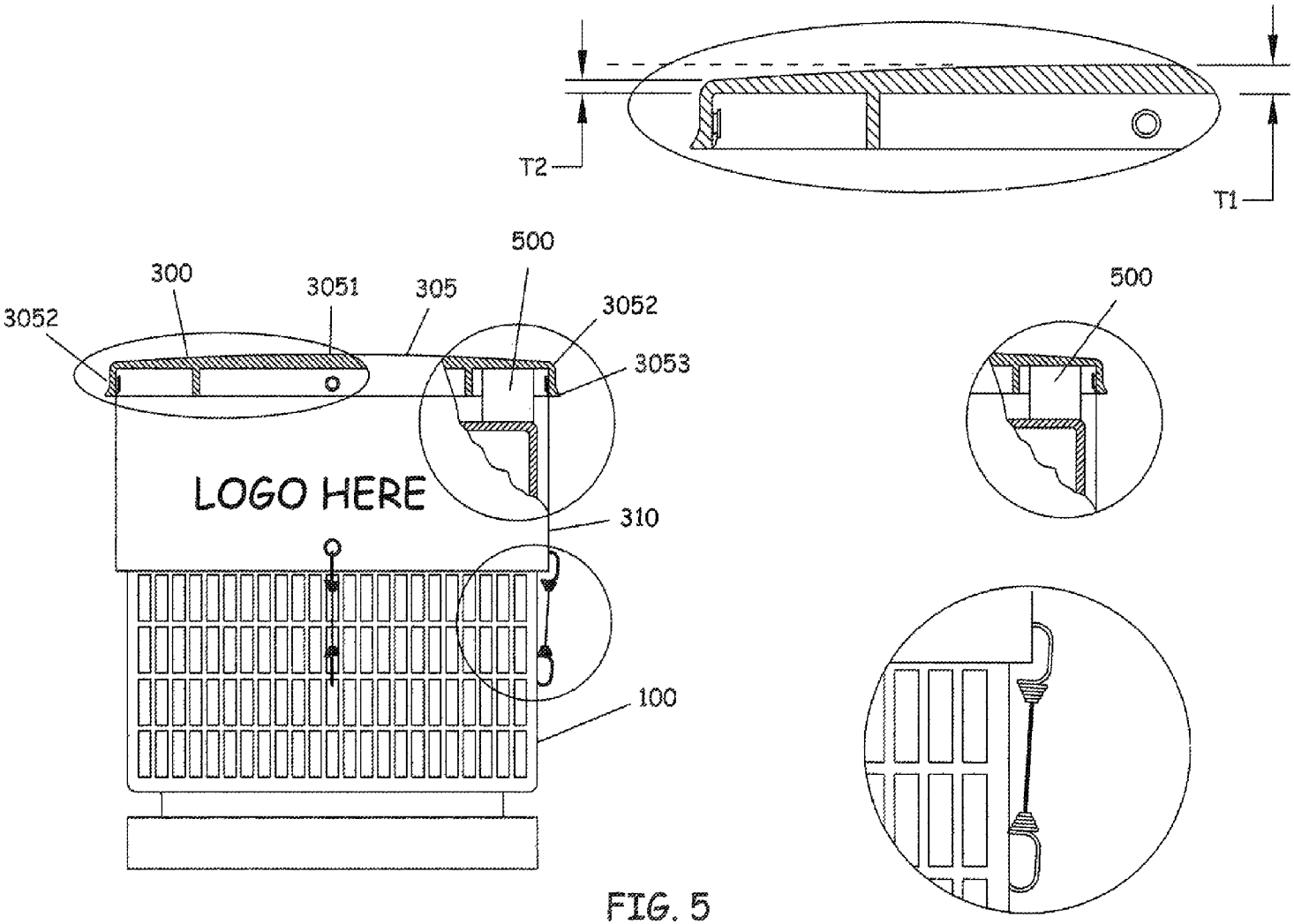
FIG. 5 is an illustration of another preferred embodiment of a protective cover for a conventional outdoor air conditioning unit.

FIG. 5 provides a representation of another preferred embodiment of an OACU cover 300. The OACU cover 300 is comprised of a panel 305 which rests on the OACU 100 and a skirt 310 which covers the sides of the OACU 300. As depicted in FIG. 5, the height of the panel 305 is not uniform. The center 3051 of the panel is thicker than the side edges 3052 of the panel. The panel center 3051 thickness is represented as T1 and the panel side edge 3052 thickness is represented as T2. T1 is greater than T2. This creates a slope away from the center 3051 of the panel 305 and allows for moisture to drain away from the panel 305. In this embodiment, there is also a lip 3053 along the lower portion of the side edge 3052 of the panel 305. This lip 3053 allows moisture and debris falling off the panel to project away from the OACU 100. In another preferred embodiment, the lip 3053 is less pronounced and the sides of the panel 305 flare out such that the lower portion of the panel 305 is wider than the upper portion of the panel 305. Please note that in order to improve the view of the crown and side lip of the cover that these items are not drawn to scale.

Various embodiments of the present invention have been presented in this specification. The various embodiments used to describe the principles of the present invention are by way of illustration only and should not be construed in any way to limit the scope of the invention. Those skilled in the art will understand that the principles of the present invention may be implemented in any suitably arranged device.

I claim:

1. A protective cover for an outdoor air conditioning unit, said outdoor air conditioning unit comprising a top face with a length and width and a grill guard, comprising:

a panel possessing a top face with a length and width, a side edge, and a bottom face and a semi-permeable skirt, wherein the length and width of the panel top face are each longer than the respective length and width of the outdoor air conditioning unit top face.

2. The protective cover recited in claim 1, wherein the panel and skirt are resistant to ultraviolet light.

3. The protective cover recited in claim 2, wherein the panel is lightweight.

4. The protective cover recited in claim 3 further comprising a lip along the lower portion of the panel side edge.

5. The protective cover recited in claim 4 wherein the panel top face possesses a center portion and edges; wherein said center portion is thicker than said edges.

6. The protective cover recited in claim 1, wherein the semi-permeable skirt has a length of no more than 75% the height of the outdoor air conditioning unit's grill guard.

7. The protective cover recited in claim 6, wherein the semi-permeable skirt has a length of at least 50% the height of the outdoor air conditioning unit's grill guard.

8. The protective cover recited in claim 6, wherein the bottom surface of the panel is non-abrasive.

9. The protective cover recited in claim 6 further comprising at least one cushion resting upon the top of the outdoor air conditioning unit wherein the bottom face of the panel rests atop the cushion to dissipate the downward force due to a falling object impacting the top face of the protective cover.

10. The protective cover recited in claim 9 further comprising at least three cushions resting upon the top of the outdoor air conditioning unit.

11. The protective cover of claim 1 wherein the outdoor air conditioning unit rests on a pad, said pad possessing a length and a width, wherein the length and width of the protective cover are approximately the same respectively as the length and width of the pad.

12. The protective cover of claim 1 wherein the semipermeable skirt comprises a polypropylene mesh.

13. A protective cover for an outdoor air conditioning unit, said outdoor air conditioning unit comprising a top face with a length and width and a grill guard, comprising:

a panel possessing a top face with a length and width, a side edge, and a bottom face;

a semi-permeable skirt;

at least one cushion;

and stretch cords each possessing a first and second end wherein the first end of each stretch cord is connected to the grill guard and the second end of each stretch cord is connected to the semi-permeable skirt and the stretch cord tension is set such that as an object striking or resting on the panel top face will cause the panel to tilt allowing said object to slide off the panel top face causing the panel to return to level.

14. A protective cover for an outdoor air conditioning unit, said outdoor air conditioning unit comprising a top face with a length and width and a grill guard, comprising:

a panel possessing a top face, a side edge, and a bottom face, wherein the panel top face has a center portion and side edges, a semi-permeable skirt, and a lip along the lower portion of the panel side edge;

wherein the panel is lightweight and center portion of said top face is thicker than said side edges of said panel top face.

* * * * *